US006871625B1

(12) United States Patent
Burke

(10) Patent No.: US 6,871,625 B1
(45) Date of Patent: Mar. 29, 2005

(54) VEHICLE WITH SWITCHED SUPPLEMENTAL ENERGY STORAGE SYSTEM FOR ENGINE CRANKING

(75) Inventor: James O. Burke, Richmond, IL (US)

(73) Assignee: Kold Ban International, Ltd., Lake in the Hills, IL (US)

( * ) Notice: Subject to any disclaimer, the term of this patent is extended or adjusted under 35 U.S.C. 154(b) by 0 days.

(21) Appl. No.: 10/764,990

(22) Filed: Jan. 26, 2004

(51) Int. Cl.[7] ..... F02N 17/00

(52) U.S. Cl. ..... 123/179.24; 123/179.1; 290/38 R

(58) Field of Search ..... 123/179.1, 179.3, 123/179.24; 290/38 R

(56) References Cited

U.S. PATENT DOCUMENTS

| | | | |
|---|---|---|---|
| 2,659,042 | A | 11/1953 | Anderson |
| 3,638,108 | A | 1/1972 | Channing |
| 3,942,027 | A | 3/1976 | Fima |
| 4,161,682 | A | 7/1979 | Corvett |

(Continued)

FOREIGN PATENT DOCUMENTS

JP 2-175351 7/1990

OTHER PUBLICATIONS

Charge All Wheel Type Battery Chargers (Model 13–012 Boost All, Good All Mfg. 1999).
The Intra Switch, Intra USA 1998.
Battery Optimizer, Purkey's Fleet Electric Inc. 1999.
Low Voltage Disconnects Switches and Alarms, Sure Power Industries Inc. 1998.
U.S. Appl. No. 09/802,284, filed May 1, 2001, entitled "Vehicle with Switched Supplemental Energy System for Engine Cranking."
Copy of U.S. Provisional Application No. 60/292,791, filed May 22, 2001, entitled "Vehicle with Switched Energy Storage System for Engine Cranking."

(Continued)

*Primary Examiner*—Bibhu Mohanty
(74) *Attorney, Agent, or Firm*—Brinks Hofer Gilson & Lione

(57) ABSTRACT

An engine cranking system includes an engine, a cranking motor coupled to the engine and a battery having first and second battery terminals. The first battery terminal is electrically coupled to the cranking motor and the second battery terminal is electrically coupled to a system ground. A capacitor includes first and second capacitor terminals. First and second electrical paths interconnect the first and second capacitor terminals, respectively, with the cranking motor and the system ground. First and second switches include first and second sets of switch terminals respectively. The first set of switch terminals is coupled between the first battery terminal and the cranking motor. A relay is included in one of the first and second electrical paths and has first and second control terminals. The second set of switch terminals is coupled between one of the first and second capacitor terminals and the second control terminal. The other of the first and second capacitor terminals is electrically coupled with the first control terminal. The relay is moveable between at least a closed-circuit position, in which the relay completes one of the first and second electrical paths, and an open-circuit condition, in which the relay interrupts one of the first and second electrical paths. In one embodiment, a running engine sensory component is coupled between one of the system ground and the first battery terminal and one of the first and second control terminals. The running engine sensory component maintains the relay in the closed-circuit position when the engine is running.

27 Claims, 4 Drawing Sheets

U.S. PATENT DOCUMENTS

| | | | | |
|---|---|---|---|---|
| 4,488,147 | A | | 12/1984 | Signorile |
| 4,492,912 | A | | 1/1985 | Nowakowski |
| 4,494,162 | A | | 1/1985 | Eyler |
| 4,510,431 | A | | 4/1985 | Winkler |
| 4,540,929 | A | | 9/1985 | Binkley |
| 4,727,306 | A | | 2/1988 | Misak et al. |
| 4,857,820 | A | | 8/1989 | Tompkins et al. |
| 4,902,955 | A | | 2/1990 | Manis et al. |
| 4,949,684 | A | * | 8/1990 | Gohara ..... 123/179.3 |
| 5,039,930 | A | | 8/1991 | Collier et al. |
| 5,077,513 | A | | 12/1991 | Dea et al. |
| 5,146,095 | A | | 9/1992 | Tsuchiya et al. |
| 5,155,373 | A | | 10/1992 | Tsuchiya et al. |
| 5,157,267 | A | | 10/1992 | Shirata et al. |
| H1172 | H | | 4/1993 | Gorniak |
| 5,207,194 | A | | 5/1993 | Clerici |
| 5,260,637 | A | | 11/1993 | Pizzi |
| 5,321,389 | A | | 6/1994 | Miester |
| 5,371,455 | A | | 12/1994 | Chen |
| 5,563,454 | A | | 10/1996 | Araki et al. |
| 5,589,292 | A | | 12/1996 | Rozon |
| 5,637,978 | A | | 6/1997 | Kellet et al. |
| 5,642,696 | A | | 7/1997 | Matsui |
| 5,783,872 | A | | 7/1998 | Blair |
| 5,793,185 | A | | 8/1998 | Prelec et al. |
| 5,818,115 | A | | 10/1998 | Nagao |
| 5,925,938 | A | | 7/1999 | Tamor |
| 5,963,417 | A | | 10/1999 | Anderson et al. |
| 5,998,961 | A | | 12/1999 | Brown |
| 6,018,199 | A | | 1/2000 | Shiroyama et al. |
| 6,034,492 | A | | 3/2000 | Saito et al. |
| 6,057,667 | A | | 5/2000 | Mills |
| 6,075,331 | A | | 6/2000 | Ando et al. |
| 6,130,519 | A | | 10/2000 | Whiting et al. |
| 6,133,645 | A | | 10/2000 | Scribner et al. |
| 6,160,373 | A | | 12/2000 | Dunn et al. |
| 6,163,088 | A | | 12/2000 | Codina et al. |
| 6,211,577 | B1 | | 4/2001 | Alksnat et al. |
| 6,212,054 | B1 | | 4/2001 | Chan |
| 6,222,342 | B1 | | 4/2001 | Eggert et al. |
| 6,242,887 | B1 | | 6/2001 | Burke |
| 6,265,851 | B1 | | 7/2001 | Brien et al. |
| 6,325,035 | B1 | | 12/2001 | Codina et al. |
| 6,362,595 | B1 | | 3/2002 | Burke |
| 6,426,606 | B1 | | 7/2002 | Purkey |
| 6,679,212 | B2 | | 1/2004 | Kelling |
| 2003/0075134 | A1 | | 4/2003 | Burke |

OTHER PUBLICATIONS

U.S. Appl. No. 09/652,686, filed Aug. 31, 2000, entitled "Vehicle with Supplemental Energy Storage System for Engine Cranking."

U.S. Appl. No. 10/085,427 filed Feb. 28, 2002, Inventors: Burke and Solberg.

U.S. Appl. No. 09/838,005, filed Apr. 18, 2001, Inventor: James O. Burke.

Miller et al., SAE Technical Paper Series 982794 entitled "Truck Starting Using Electrochemical Capacitors," copyrighted 1998, pp. 1–7.

Miller, John R., "Engineering Battery Capacitor Combinations in High Power Applications: Diesel Engine Starting," presented at "The 9th International Seminar on Double Layer Capacitors and Similar Energy Storage Devices," Deerfield Beach, Florida, pp. 1–11, Dec. 6–8, 1999.

KBi KAPower "Installation–Operation Manual," KBi/Kold– Ban International, Ltd., KBi Form #131137 Rev. 06/00, pp. 1–11,2000.

KBi, "KBi Kranking Kap Super Capacitors," KBi Publication, 2000, 2 pages.

"KAPower Super Capacitors," Kold–Ban International, Ltd., brochures, 2000, 2 pages.

KBi, "KrankingKart Professional Jump–Start Unit," obtained at the internet address: http://www.koldban.com/mainpages/karts.htm, Aug. 30, 2001, 3 pages.

* cited by examiner

VEHICLE WITH SWITCHED SUPPLEMENTAL ENERGY STORAGE SYSTEM FOR ENGINE CRANKING

BACKGROUND

The present invention relates to vehicles of the type that include an internal combustion engine, a cranking motor, and a battery normally used to power the cranking motor. In particular, this invention relates to improvements to such systems that increase of the reliability of engine starting.

A problem presently exists with vehicles such as heavy-duty trucks. Drivers may on occasion run auxiliary loads excessively when the truck engine is not running. It is not unusual for heavy-duty trucks to include televisions and other appliances, and these appliances are often used when the truck is parked with the engine off. Excessive use of such appliances can drain the vehicle batteries to the extent that it is no longer possible to start the truck engine.

Various systems have been developed that use a capacitor to supplement the vehicle batteries such that the vehicle can be started. Often, however, the capacitor is not completely isolated, and can lose its charge over time, for example by leaking through one or more diodes. In other systems, wherein the capacitor is completely isolated when not in use, the capacitor is also isolated from the one or more switches or relays used to connect the capacitor to the cranking motor, such that the capacitor cannot be used to close the switch or relay to bring the capacitor on line.

SUMMARY

In one aspect, an engine cranking system includes an engine, a cranking motor coupled to the engine and a battery having first and second battery terminals. The first battery terminal is electrically coupled to the cranking motor and the second battery terminal is electrically coupled to a system ground. A capacitor includes first and second capacitor terminals. First and second electrical paths interconnect the first and second capacitor terminals, respectively, with the cranking motor and the system ground. First and second switches include first and second sets of switch terminals respectively. The first set of switch terminals is coupled between the first battery terminal and the cranking motor. A relay is included in one of the first and second electrical paths and has first and second control terminals. The second set of switch terminals is coupled between one of the first and second capacitor terminals and the second control terminal. The other of the first and second capacitor terminals is electrically coupled with the first control terminal. The relay is moveable between at least a closed-circuit position, in which the relay completes one of the first and second electrical paths, and an open-circuit condition, in which the relay interrupts one of the first and second electrical paths.

In one preferred embodiment, the relay is included in the second electrical path, wherein the second set of switch terminals is coupled between the second capacitor terminal and the second control terminal, and wherein the first capacitor terminal is electrically coupled with the first control terminal. In one preferred embodiment, the first and second switches are configured as a double pole, single-throw switch. In an alternative embodiment, the relay is included in the first electrical path.

In one aspect, a running engine sensory component is coupled between one of the system ground and the first battery terminal and one of the first and second control terminals. The running engine sensory component maintains the relay in the dosed-circuit position when the engine is operated in the running condition. In one embodiment, the running engine sensory component includes a normally open oil pressure switch that is electrically coupled between the system ground and the second control terminal. The normally open oil pressure switch is positionable in a closed position in response to at least a predetermined minimum oil pressure being applied thereto.

In another aspect, a method of starting an engine includes simultaneously closing the first and second switches, applying a control voltage to the relay with the capacitor through the second switch, and positioning the relay in the closed-circuit condition in response to the control voltage being applied thereto and thereby completing one of the first and second electrical paths.

The various preferred embodiments provide significant advantages over other engine cranking systems. In particular, the capacitor is completely isolated when the ignition switch is not in the start position. Accordingly, the capacitor cannot be inadvertently discharged, and it cannot leak over time, for example, through a diode. Moreover, the capacitor can be brought on line to close the relay simply by moving the switch to the start position. Accordingly, the system avoids inadvertent discharge while also making the capacitor available to close the relay.

This section has been provided by way of general introduction, and it is not intended to narrow the scope of the following claims.

DETAILED DESCRIPTION OF THE PREFERRED EMBODIMENTS

Figure 1:
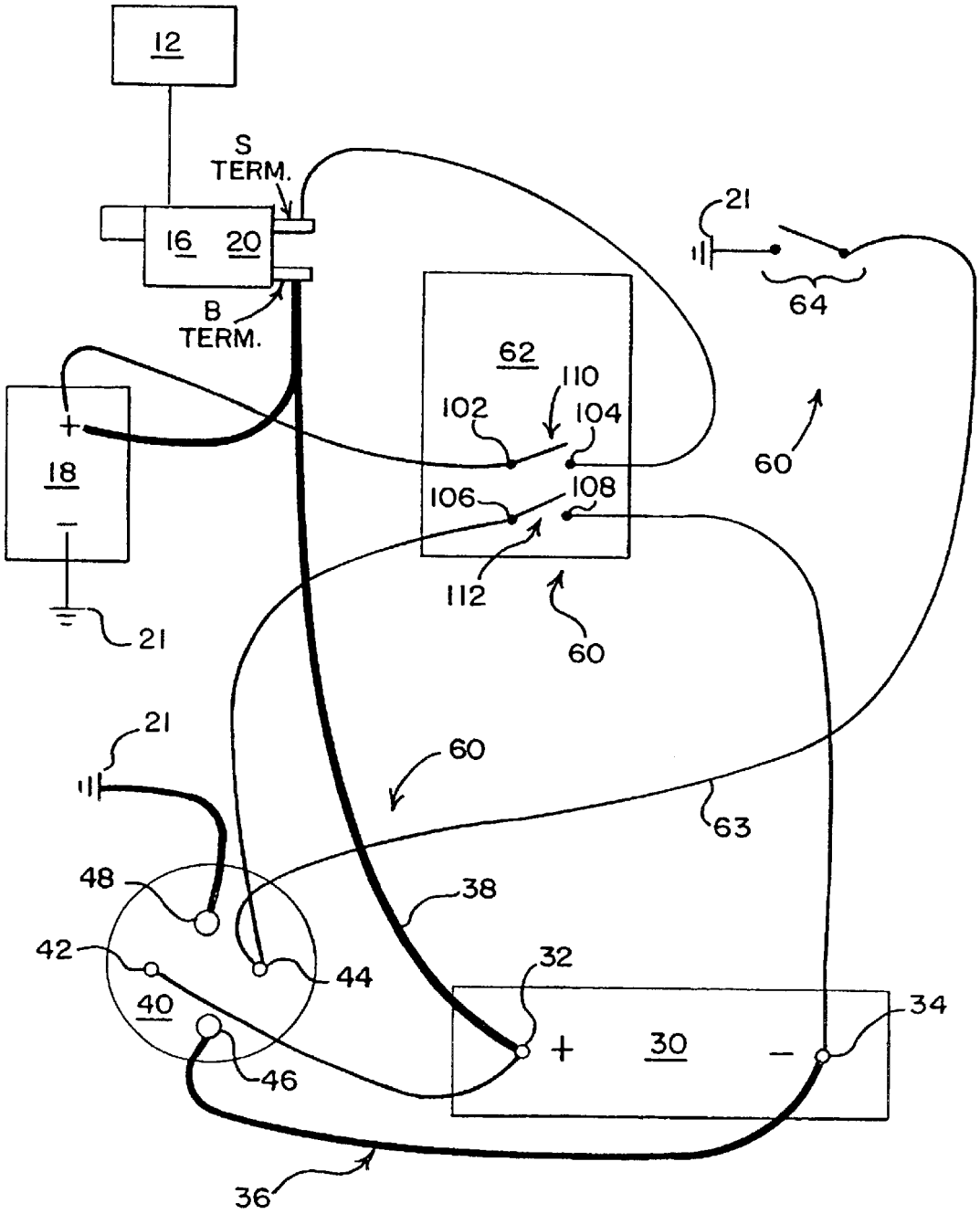
FIG. 1 is a schematic diagram of a first embodiment of a vehicle electrical system that incorporates a preferred embodiment of this invention, showing an ignition switch in the open position and an oil pressure switch in an open position, with a relay in an open-circuit condition.

Turning down to the drawings, FIGS. 1–4 show an electrical system of a vehicle (not shown) that includes an internal combustion engine 12. The engine 12 can take any suitable form, and may for example be a conventional diesel or gasoline engine. The engine 12 is mechanically coupled to a cranking motor 16. The cranking motor 16 can take any suitable form, and it is conventionally an electrical motor that is powered during cranking conditions by current from one or more storage batteries 18 such as conventional lead-acid batteries. Current from the batteries 18 is switched to the cranking motor 16 via a switch such as a conventional solenoid switch 20. In operation, the engine is operably moved between a running condition and an off condition.

All of the elements 12 through 20 described above may be entirely conventional, and are well-known to those skilled in the art. The present invention is well adapted for use with the widest variety of alternative embodiments of these elements.

In addition to the conventional electrical system described above, the vehicle also includes a supplemental electrical system including a capacitor 30. The capacitor 30 is preferably a double layer capacitor of the type known in the art as an electrochemical capacitor. Suitable capacitors may be obtained from KBI, Lake in the Hills, IL under the trade name KAPower. For example, in one alternative embodiment, the capacitor 30 has a capacitance of 1000 farads, a stored energy capacity of 60 kilojoules, an internal resistance at −30 degrees Celsius of 0.003 ohms, and a maximum storage capacity of 17 kilowatts. In general, the capacitor should have a capacitance greater than 150 farads, and an internal resistance at 20° C. that is preferably less than 0.008 ohms, more preferably less than 0.006 ohms, and most preferably less than 0.003 ohms. The energy storage capacity is preferably greater than 15 kJ. Such capacitors provide the advantage that they deliver high currents at low temperatures and relatively low voltages because of their unusually low internal resistance. Further information about suitable capacitors for use in the system of FIGS. 1–3 can be found in publications of ESMA, Troitsk, Moscow region, Russia and on the Internet at www.esmacap.com.

The capacitor 30 includes a positive terminal 32 and a negative terminal 34. The positive terminal 32 is connected with the cranking motor via an electrical path 38 that includes a suitable cable and the solenoid switch 20. The negative terminal 34 is connected to system ground 21 by another electrical path 36 that includes suitable cables and a relay 40. The relay 40 includes first and second control terminals 42, 44 and first and second switched terminals 46, 48. The switched terminals 46, 48 are included in the electrical path 36 such that the relay 40 interrupts the electrical path 36 when the relay is in an open-circuit condition. The relay 40 completes the electrical path 36 when the relay is in a closed-circuit condition.

The relay 40 may take many forms, and may include an electromechanical switch or a solid-state switch. By way of example, a 500 amp, 12 volt electromechanical relay can be used such as that supplied by kissling as part number 29.511.11. As an example of a suitable solid-state relay, the MOSFET switch sold by Intra USA under the trade-name Intra Switch can also be used.

The relay 40 is controlled (e.g., closed) by a first portion of a control circuit 60 that applies a voltage between the control terminals 42 and 44. In one embodiment, the first portion of the control circuit is coupled between the positive and negative terminals 32, 34 of the capacitor. The relay 40 can also be controlled or closed by another portion of the control circuit 60 extending between the positive terminal of the battery 18 and ground 21, which circuit is defined at least in part by the electrical path from the positive terminal of the battery to the B terminal, from the B terminal to the positive terminal 32 of the capacitor and from the positive terminal 32 of the capacitor to the relay control terminal 42. The second portion of the control circuit 60 is completed by the electrical path across the relay control terminals 42, 44 to ground 21 through a running engine sensory component 64.

Figure 2:
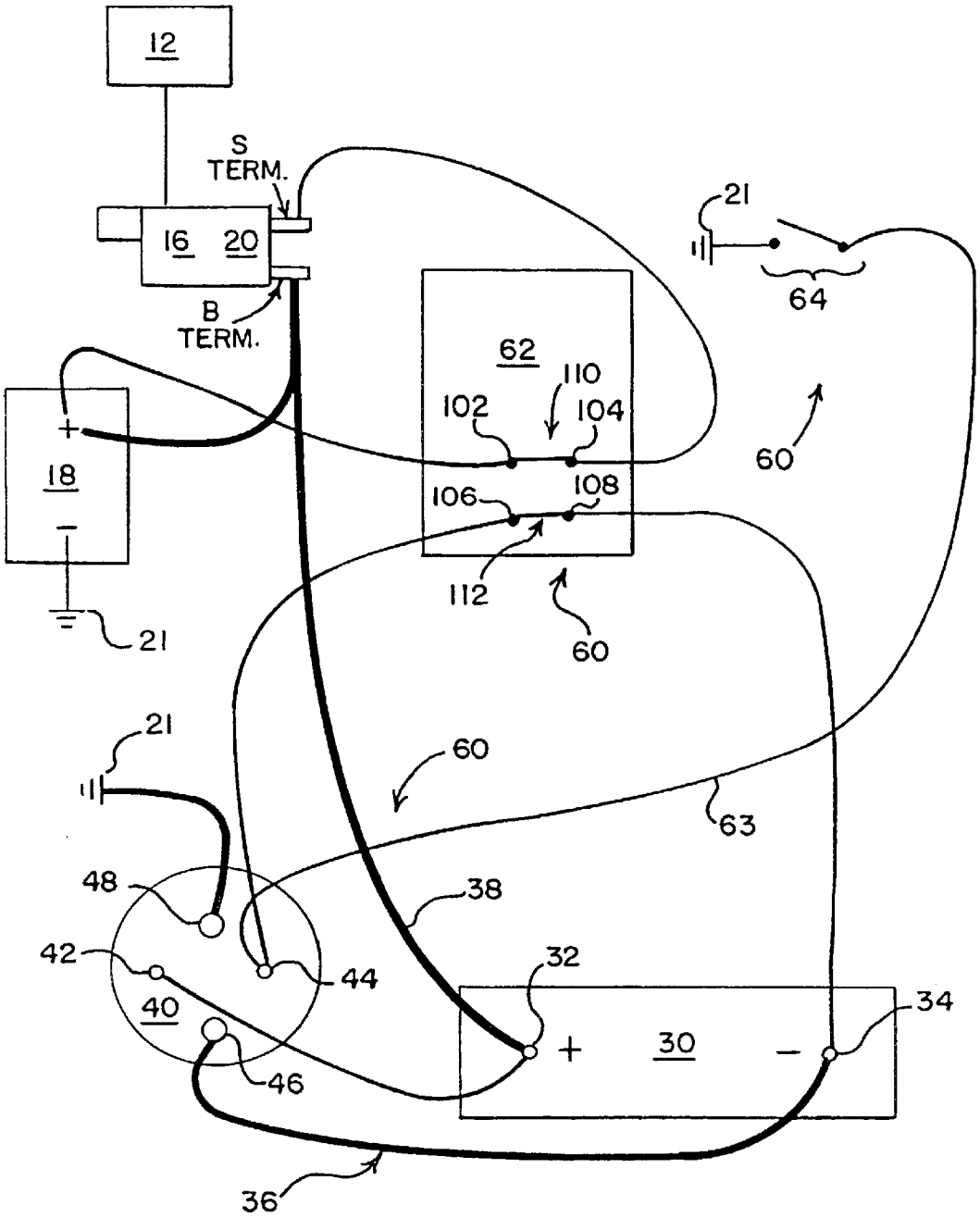
FIG. 2 is a schematic diagram of the system of FIG. 1, showing the ignition switch in a closed position and the oil pressure switch in the open position, with the relay in a closed-circuit condition.

As shown in FIGS. 1–2, the first portion of the control circuit 60 includes a first switch 110 that is preferably configured as part of the ignition switch 62 of the vehicle. A conventional ignition switch includes four positions: accessory, off, on/run, and start. Of course, in other embodiments, other switches having other positions can be used. In addition, in some embodiments, a switch can be positioned between at least an off and run position, and a separate push-button, crank switch is actuated to crank the motor. In such an embodiment, one or both of the off/run switch and the separate push-button switch are defined as an ignition switch.

Figure 3:
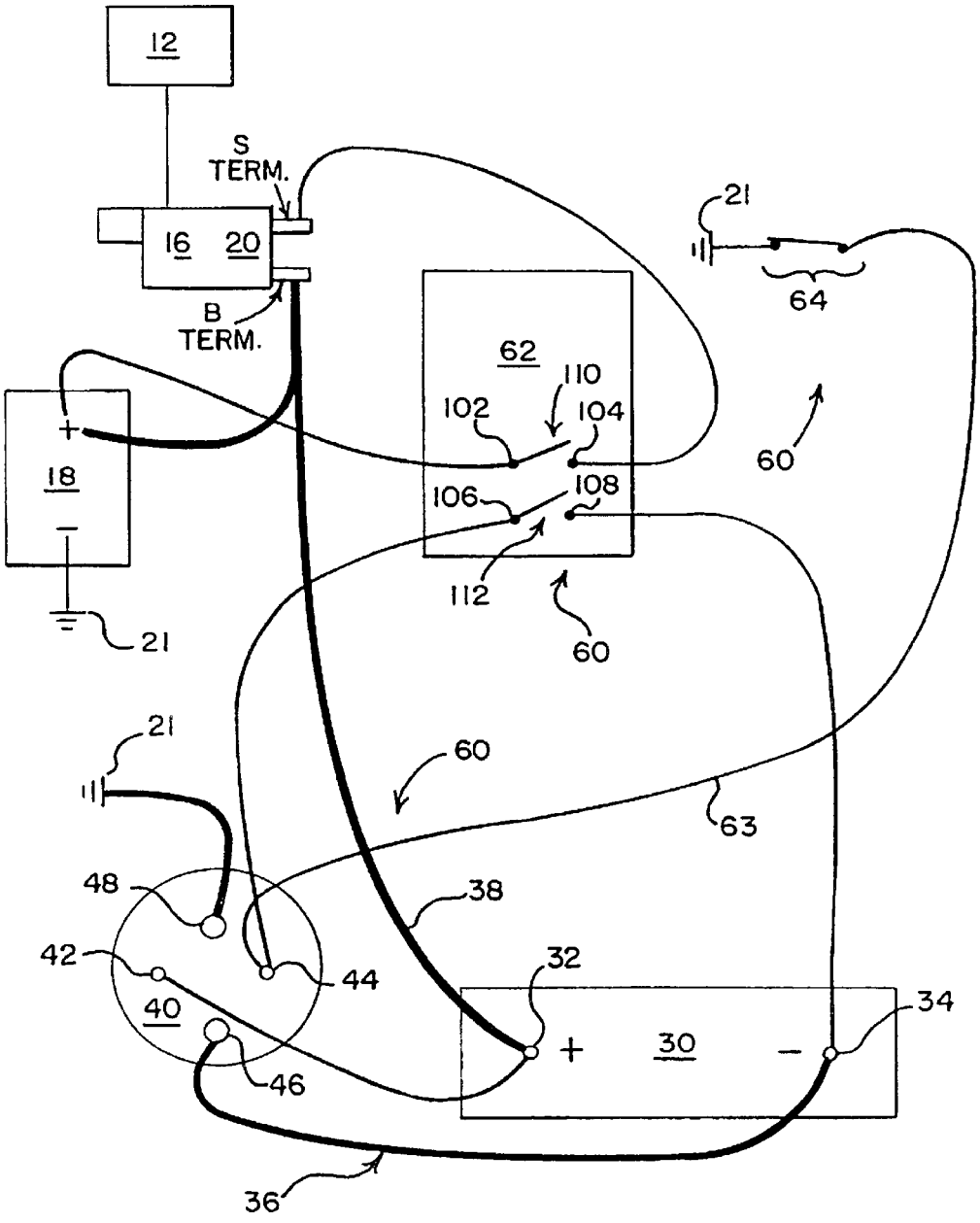
FIG. 3 is a schematic diagram of the system of FIG. 1, showing the ignition switch in an open position and the oil pressure switch in a closed position, with the relay in a closed-circuit condition.

In one embodiment, shown in FIGS. 1–3, the ignition switch 62 is configured as a single proprietary double-pole, single throw switch, which closes the switch 110 when moved to a start position. In another embodiment, shown in FIG. 4, the ignition switch includes a double-pole, single throw switch 62 and a conventional ignition switch 67 moveable between the accessory, off and on/run positions (the start position is disabled or rendered inoperative). Alternatively, as shown in FIG. 4, the ignition switch includes the double-pole, single throw switch 62 and another conventional ignition switch 65 moveable between the off and on/run positions.

In one embodiment, shown in FIGS. 1–3, the switch 110 has first and second switch terminals 102, 104 electrically connected between the positive terminal of the battery and the S terminal of the cranking motor 16. In the embodiments of FIG. 4, one of the switches 63 and 65 is positioned between the battery and the terminal 102 of the switch 110. In the embodiments of FIGS. 1–4, the control circuit 60 further includes a second switch 112 that is also part of the ignition switch 62. In particular, the first and second switches 110, 112 are configured as part of the double-pole, single-throw switch 62, wherein each switch 110, 112 has a proprietary pole. One suitable double-pole, single-throw switch is the Alco Switch Part No. MPG206R. The switch 112 has first and second switch terminals 106, 108 electrically connected between the negative terminal of the capacitor and the control terminal 44 of the relay.

When the switch 112 is closed, the capacitor applies a control signal or control voltage to the relay 40 through the switch 112. In this example, when the switch 112 is closed, the control signal is held at a positive voltage across the control terminals 42, 44 (assuming the capacitor 30 and/or battery 18 are charged), and this positive voltage places the relay 40 in a closed-circuit condition, which places the negative terminal 34 in low-resistance contact with the cranking motor 16, or system ground 21. Alternatively, and referring to FIGS. 1–3, when the switch 112 is open, for example when the ignition switch 62 is in any of the off, on/run or accessory positions, the control signal zero voltage, and the relay 40 is in an open-circuit condition. In this condition the relay 40 interrupts the electrical path 36, thereby isolating the negative terminal 34 of the capacitor 30 from the cranking motor 16, or other system ground.

Figure 4:
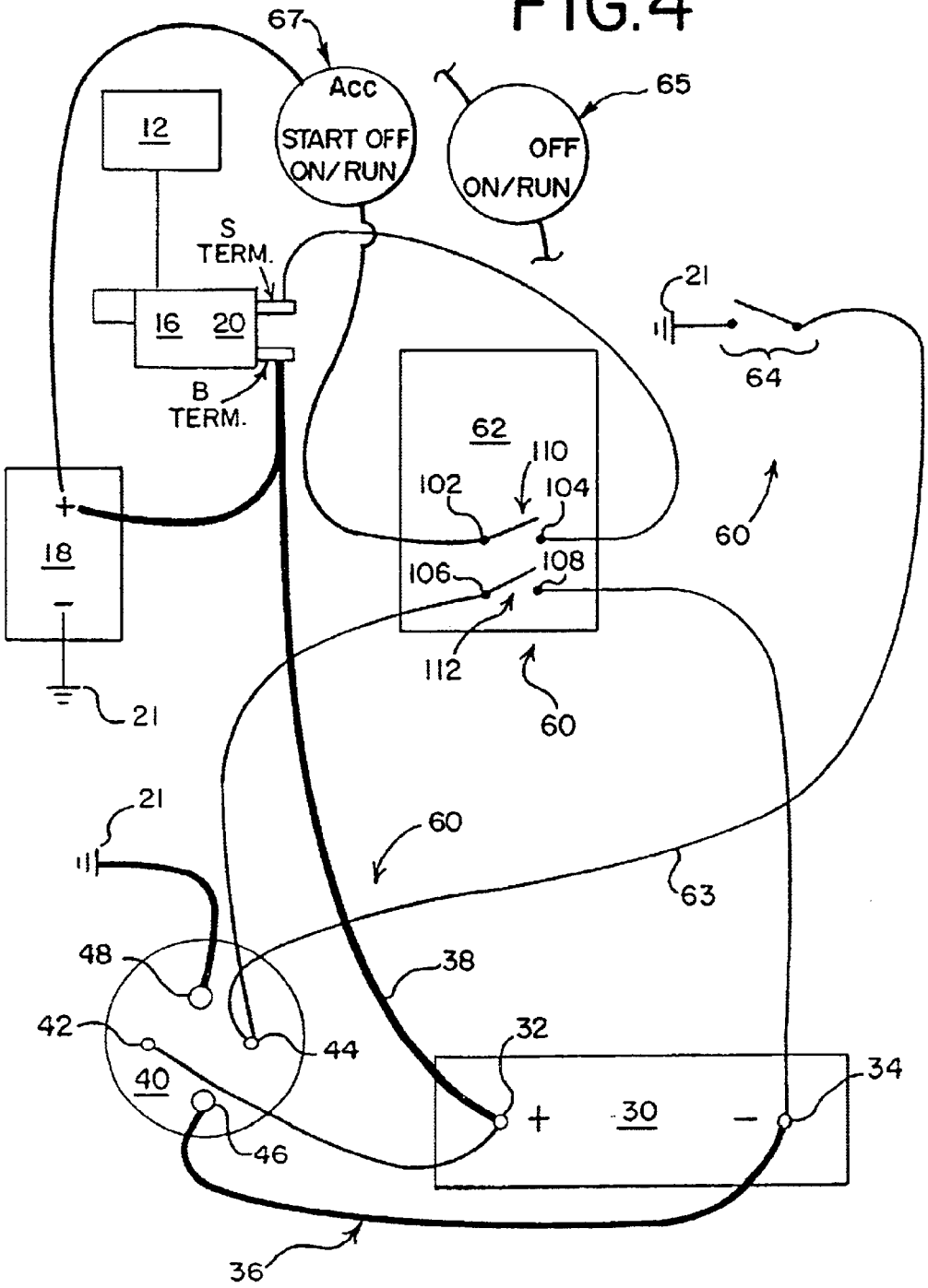
FIG. 4 is a schematic diagram of a second embodiment of a vehicle electrical system that incorporates a preferred embodiment of this invention, showing an ignition switch in the open position, with the relay in an open-circuit condition.

Referring to FIG. 4, the user places one of the switches 67, 65 in the on/run position. The user then closes the switches 110 and 112, such that the capacitor 30 is brought on line to close the relay 40. In one sequence, when there is insufficient charge in the battery 18 and/or capacitor 30 to crank the motor, the user can maintain and/or place the switches 67, 65 in one of the accessory or off positions and separately close the switch 62, which closes the switches 110, 112 and subsequently the relay 40. Because the switches 67, 65 are not in the run position, the engine is not cranked. Instead, in this position, the battery 18 is put in parallel with the capacitor and can charge the capacitor 30. Because of the low resistance of the capacitor 30, the capacitor can be charged by the battery to a voltage capable of cranking the engine 12, even if the battery 18, with its high resistance, and the capacitor initially were not able to crank the engine.

If the switches 110, 112 are closed, the user merely turns the switch 67 or 65 to the run position, which will close the circuit and bring the capacitor and battery on line to crank the engine. Alternatively, the user can open the switch 62 and corresponding switches 110, 112, turn the switch 67 or 65 to the on/run position, and then close the switch 62 (including switches 110 and 112) to crank the motor. After the engine is started, the user releases or opens the switch 62 (and the corresponding switches 110, 112). The running engine sensory component 64 can then be operated to maintain the relay 40 in a closed-circuit condition as explained below.

As set forth above, and with reference to FIGS. 1–4, the control circuit 60 further includes a running engine sensory component 64 electrically connected between the system ground 21 and the control terminal 44 of the relay with a conductor 63. The running engine sensory component 64 senses then the engine is in a running condition and maintains the relay 40 in a closed-circuit condition while the engine is running.

For example, in one embodiment, the running engine sensory component 64 is configured as a normally open oil pressure switch. One suitable oil pressure switch is available from Nason Co., located in West Union, N.C. under Part No. SM-2A-5R. When the oil pressure of the engine 12 rises above a set value, or a minimum predetermined value, for example when the engine is running, the normally open oil pressure switch 64 closes, thereby applying a positive voltage across the control terminals 42, 44 from the battery 18 though the B terminal, electrical path 38 and the path between terminals 32 and 42 to system ground 21. The term "running" as used herein means that the engine crank shaft is turning, for example by way of the cranking motor and/or by way of internal combustion.

In various exemplary preferred embodiments, the minimum predetermined oil pressure is greater than or equal to about 5 psi, alternatively between about 5 psi and about 50 psi, and alternatively between about 10 psi and 30 psi, although it should be understood that it could be a greater or lesser value. When a positive voltage is applied via the conductor across the control terminals 42, 44, the relay 40 is placed in a closed-circuit condition, which completes the circuit and places the negative terminal 34 in low-resistance contact with the cranking motor 16, or system ground 21. Thus, the oil pressure switch 64 closes the relay 40 and connects the capacitor 30 to the electrical system including the batteries 18 throughout the time that the engine 12 is running. This allows the engine alternator (not shown) to recharge the capacitor 30.

Other running engine sensory components include for example and without limitation various switches or devices responsive to pressure/vacuum (e.g., from the manifold), alternator output, and/or revolutions (e.g., flywheel output). In one example, the running engine sensory component includes an Engine Control Module (ECM), which provides a signal that the engine is running, which signal maintains the relay 40 in a closed-circuit condition.

The operation of the system described above will be explained in conjunction with FIGS. 1–3. Though not shown in the Figures, the electrical system of the vehicle includes a conventional generator or alternator driven by the engine when running to charge both the batteries 18 and capacitor 30. FIG. 1 shows the state of the system when the first switch 110 is opened, as for example when the ignition switch 62 of the vehicle is in the off position, the accessory position or the on/run position. When the first switch 110 is opened, the second switch 112, which is connected to the first switch 110 and moves simultaneously therewith, is also opened. As such, the capacitor 30 is isolated from the relay 40, such that it is prevented from discharging, and the relay 40 is in placed in the open-circuit condition. The driver of the vehicle is free to use accessory power as desired, but such usage will at most drain the batteries 18, while leaving the capacitor 30 in a full state of charge.

FIG. 2 shows the state of the system when the ignition switch 62 is moved to the start position. In particular, the first switch 110 component is closed thereby bringing the battery 18 on line to supply power to the cranking motor 16. At the same time, or simultaneously with the first switch component 110, the second switch component 112 is also closed, thereby applying a voltage from the capacitor 30 to the relay control terminals 42, 44 and placing the relay 40 in the closed-circuit condition. In this state, the relay 40 connects the negative terminal 34 and system ground 21, thereby reconnecting the capacitor 30 with the electrical system of the vehicle and making the power stored in the capacitor 30 available for use in engine cranking.

Thereafter, as shown in FIG. 3, the ignition switch 62 is preferably placed in the run position, with the first and second switch components 110, 112 thereby being opened. In this position, the relay 40 is not maintained in the closed-circuit position by the capacitor 30. Rather, for example in one embodiment, as the engine is cranked and started, the oil pressure rises to or above the minimum predetermined oil pressure (e.g., 5 psi) such that the oil pressure switch 64 is dosed. Preferably, the oil pressure switch 64 is closed prior to the user placing the ignition switch 62 in the run position. In this way, a voltage is continuously applied across the relay control terminals 42, 44 to maintain the relay 40 in a closed-circuit position, with the control voltage first being applied by the capacitor 30 across the terminals 42, 44 when the switch 112 is closed, and thereafter being applied by the battery 18 or alternator by way of the oil pressure switch 64 to system ground 21. Of course, in other embodiments, running engine sensory components other than an oil pressure switch, as described above, can be used to maintain the relay 40 in the closed-circuit condition while the engine is running. In addition, it should be understood that the running engine sensory components, such as the oil pressure switch, can be positioned in the electrical path connected to the positive terminal of the capacitor, rather than in the path connected to system ground.

In this way, the relay 40 is maintained in the closed-circuit condition and connects the capacitor 30 to the electrical system including the batteries 18 throughout the time that the engine 12 is running, or until the running engine sensory component, e.g. the oil pressure switch 64, is opened, for example when the engine is turned off and the oil pressure falls below the predetermined minimum oil pressure. In this way, the engine alternator (not shown) recharges the capacitor 30 while the engine is running.

Referring to FIGS. 1–3, it should be apparent that the control circuit 60 operates automatically to connect the capacitor 30 with the electrical system of the vehicle while the engine 12 is running and the oil pressure (or other sensory input) is at or above the predetermined level, as well as during periods of engine cranking. This is accomplished without any driver intervention. Also, when the engine is not running and the oil pressure is below the predetermined level, and when the engine is not being cranked, the control circuit 60 automatically causes the relay 40 to open, thereby disconnecting the capacitor 30 from the electrical system of the vehicle. For this reason, the vehicle operator cannot inadvertently drain the capacitor 30 with auxiliary loads, for example when leaving the ignition switch in the run/on position. The driver of the vehicle is free to use accessory power as desired, regardless of whether the ignition switch is in the run position or the accessory position, and such usage will at most drain the batteries 18, leaving the capacitor 30 in a full state of charge.

In particular, though not shown in FIGS. 1–3, the electrical system of the vehicle 10 includes a conventional generator or alternator driven by the engine 12 when running to charge both the batteries 18 and the capacitor 30. Thus, the capacitor 30 is generally fully charged when the engine is shut down. Because the relay 40 is in the open-circuit condition, this state of charge of the capacitor 30 is preserved.

The systems described above provide a number of important advantages. The supplemental electrical system including the capacitor 30 provides adequate current for reliable engine starting, even if the batteries 18 are substantially discharged by auxiliary loads when the engine 12 is not running. If desired, the supplemental electrical system including the capacitor 30 may be made invisible to the user of the vehicle. That is, the vehicle operates in the normal way such that the starting advantages provided by the capacitor 30 are obtained without any intervention on the part of the user. The capacitor is automatically disconnected from the vehicle electrical system when the vehicle is turned off, and automatically reconnected to the vehicle electrical system when the engine is started.

Additionally, the capacitor 30 provides the advantage that it can be implemented with an extremely long-life device that can be charged and discharged many times without reducing its efficiency in supplying adequate cranking current. This system does not interfere with conventional availability of the batteries 18 to power accessories when the engine is off. This reduces the incentive of the vehicle operator to defeat the system.

Referring to the embodiments of FIGS. 1–3, the control system 60 is powered with the stored voltage on the capacitor 30 and/or the batteries 18. Thus, as long as the capacitor 30, includes an adequate charge to start the engine 12, it will provide an adequate voltage to close the relay 40. This is a substantial advantage, because if the control circuit 60 were connected simply between the positive terminal of the capacitor and system ground, a condition might arise in which the batteries 18 stored insufficient charge to close the relay 40, thereby preventing an operator from starting the engine 12 even though adequate charge was available in the capacitor 30.

As used herein, the terms "connected" and "coupled with" are intended broadly to encompass direct and indirect coupling. Thus, first and second elements are said to be coupled with one another whether or not a third, unnamed, element is interposed therebetween. For example, two elements may be coupled with one another by means of a switch.

The term "battery" is intended broadly to encompass a set of batteries including one or more batteries.

The term "set" means one or more.

The term "path" is intended broadly to include one or more elements that cooperate to provide electrical interconnection, at least at some times. Thus, a path may include one or more switches or other circuit elements in series with one or more conductors.

Of course, many alternatives are possible. For example, the relay can be placed in the electrical path that interconnects the positive terminal of the capacitor and the cranking motor or in both electrical paths that interconnect with the capacitor. Various switches and relays can be used to implement the functions described above, and cables and cable terminations can be adapted as appropriate. For example, it is not essential in all embodiments that an engine oil pressure switch be used to indicate when the engine is running. Rather, as explained above, other parameters indicative of engine operation can be used to control the switch 64, including without limitation alternator output, flywheel rotation, manifold pressure/vacuum and/or ECM signals.

The foregoing description has discussed only a few of the many forms that this invention can take. For this reason, this detailed description is intended by way of illustration, not limitation. It is only the claims, including all equivalents, that are intended to define the scope of this invention.

What is claimed is:

1. An engine cranking system comprising:

an engine operably moveable between a running condition and an off condition;

a cranking motor coupled to said engine;

a battery comprising first and second battery terminals, said first battery terminal electrically coupled to said cranking motor and said second battery terminal electrically coupled to a system ground;

a capacitor comprising first and second capacitor terminals;

first and second electrical paths interconnecting said first and second capacitor terminals, respectively, with said cranking motor and said system ground;

first and second switches comprising first and second sets of switch terminals respectively, wherein said first set of switch terminals is coupled between said first battery terminal and said cranking motor; and a relay included in one of said first and second electrical paths and having a first control terminal and a second control terminal, wherein said second set of switch terminals is coupled between one of said first and second capacitor terminals and said second control terminal, and wherein the other of said first and second capacitor terminals is electrically coupled with said first control terminal, and wherein said relay is moveable between at least a closed-circuit position, in which the relay completes said one of said first and second electrical paths, and an open-circuit condition, in which the relay interrupts said one of said first and second electrical paths.

2. The engine cranking system of claim 1 wherein said relay is included in said second electrical path, wherein said second set of switch terminals is coupled between said second capacitor terminal and said second control terminal, and wherein said first capacitor terminal is electrically coupled with said first control terminal, and wherein said relay completes said second electrical path when in said closed-circuit position and said relay interrupts said second electrical path when in said open-circuit position.

3. The engine cranking system of claim 1 wherein said first and second switches comprise a double pole, single-throw switch.

4. The engine cranking system of claim 3 wherein said double pole, single-throw switch comprises an ignition switch.

5. The engine cranking system of claim 1 further comprising a running engine sensory component coupled between one of said system ground and said first battery terminal and one of said first and second control terminals, wherein said running engine sensory component maintains said relay in said closed-circuit position when said engine is operated in said running condition.

6. The engine cranking system of claim 1 further comprising a running engine sensory component coupled between said system ground and said second control terminal, wherein said running engine sensory component maintains said relay in said closed-circuit position when said engine is operated in said running condition.

7. The engine cranking system of claim 6 wherein said running engine sensory component comprises a normally open oil pressure switch electrically coupled between said system ground and said second control terminal, wherein said normally open oil pressure switch is positionable in a closed position in response to at least a predetermined minimum oil pressure being applied thereto.

8. The engine cranking system of claim 7 wherein said predetermined minimum pressure is greater than or equal to about 5 psi.

9. The engine cranking system of claim 1 wherein said capacitor comprises a double layer capacitor characterized by a capacitance greater than about 150 farads and an internal resistance at 20° C. less than about 0.008 ohms.

10. The engine cranking system of claim 1 further comprising a third switch coupled between the first battery terminal and the first switch, said third switch moveable between at least an off position and a run position.

11. An engine cranking system comprising:

an engine operably moveable between a running condition and an off condition;

a cranking motor coupled to said engine;

a battery comprising positive and negative battery terminals, said positive battery terminal electrically coupled to said cranking motor and said negative battery terminal electrically coupled to a system ground;

a capacitor comprising positive and negative capacitor terminals;

first and second electrical paths interconnecting said positive and negative capacitor terminals, respectively, with said cranking motor and said system ground;

a double-pole, single throw ignition switch comprising first and second sets of switch terminals respectively, wherein said first set of switch terminals is coupled between said positive battery terminal and said cranking motor;

a relay included in said second electrical path and having first and second control terminals, wherein said second set of switch terminals is coupled between said negative capacitor terminal and said second control terminal, and wherein said positive second capacitor terminal is electrically coupled with said first control terminal, and wherein said relay is moveable between at least a closed-circuit position, in which the relay completes said second electrical path, and an open-circuit condition, in which the relay interrupts said second electrical path; and a running engine sensory component coupled between said system ground and said second control terminal, wherein said running engine sensory component maintains said relay in said closed-circuit position when said engine is operated in said running condition.

12. The engine cranking system of claim 11 wherein said running engine sensory component comprises a normally open oil pressure switch electrically coupled between said system ground and said second control terminal, wherein said normally open oil pressure switch is positionable in a closed position in response to at least a predetermined minimum oil pressure being applied thereto.

13. The engine cranking system of claim 12 wherein said predetermined minimum oil pressure is greater than or equal to about 5 psi.

14. The engine cranking system of claim 11 wherein said capacitor comprises a double layer capacitor characterized by a capacitance greater than about 150 farads and an internal resistance at 20° C. less than about 0.008 ohms.

15. The engine cranking system of claim 11 wherein said ignition switch comprises a first ignition switch and further comprising a second ignition switch coupled between the first battery terminal and the first ignition switch, said second ignition switch moveable between at least an off position and a run position.

16. A method for cranking an internal combustion engine comprising:

providing an engine cranking system comprising an engine operably moveable between a running condition and an off condition, a cranking motor coupled to said engine, a battery comprising first and second battery terminals, said first battery terminal electrically coupled to said cranking motor and said second battery terminal electrically coupled to a system ground, a capacitor comprising first and second capacitor terminals, first and second electrical paths interconnecting said first and second capacitor terminals, respectively, with said cranking motor and said system ground, first and second switches comprising first and second sets of switch terminals respectively, wherein said first set of switch terminals is coupled between said first battery terminal and said cranking motor, and a relay included in one of said first and second electrical paths and having first and second control terminals, wherein said second set of switch terminals is coupled between one of said first and second capacitor terminals and said second control terminal, and wherein the other of said first and second capacitor terminals is electrically coupled with said first control terminal, and wherein said relay is moveable between at least a closed-circuit position, in which the relay completes said one of said first and second electrical paths, and an open-circuit condition, in which the relay interrupts said one of said first and second electrical paths;

simultaneously closing said first and second switches;

applying a control voltage to said relay with said capacitor through said second switch; and positioning said relay in said closed-circuit condition in response to said control voltage being applied thereto and thereby completing said one of said first and second electrical paths.

17. The method of claim 16 wherein said relay is included in said second electrical path, wherein said second set of switch terminal is coupled between said second capacitor terminal and said second control terminal, and wherein said first capacitor terminal is electrically coupled with said first control terminal, and wherein said positioning said relay in said closed-circuit position and thereby completing said one of said first and second electrical paths comprises completing said second electrical path when said relay is positioned in said closed-circuit position and further comprising positioning said relay in said open-circuit condition and thereby interrupting said second electrical path with said relay.

18. The method of claim 16 wherein said first and second switches comprise a double pole, single-throw switch.

19. The method of claim 18 wherein said double pole, single-throw switch comprises an ignition switch.

20. The method of claim 16 further comprising providing a running engine sensory component coupled between one of said system ground and said first battery terminal and one of said first and second control terminals, operably moving said engine to said running condition in response to said simultaneously closing said first and second switches, sensing that said engine is in said running condition with said running engine sensory component, and maintaining said relay in said closed-circuit position with said running engine sensory component.

21. The method of claim 16 further comprising providing a running engine sensory component coupled between one of said system ground and said second control terminal, operably moving said engine to said running condition in response to said simultaneously closing said first and second switches, sensing that said engine is in said running condition with said running engine sensory component, and maintaining said relay in said closed-circuit position with said running engine sensory component.

22. The method of claim 21 wherein said running engine sensory component comprises a normally open oil pressure switch electrically coupled between said system ground and said second control terminal, and wherein said sensing that said engine is in said running condition comprises applying a predetermined minimum oil pressure to said normally open oil pressure switch and wherein said maintaining said relay in said closed-circuit position comprises positioning said normally open oil pressure switch in a closed position.

23. The method of claim 22 wherein said predetermined minimum oil pressure is greater than or equal to about 5 psi.

24. The method of claim 16 wherein said capacitor comprises a double layer capacitor characterized by a capacitance greater than about 150 farads and an internal resistance at 20° C. less than about 0.008 ohms.

25. The method of claim 16 further comprising providing a third switch coupled between the first battery terminal and the first switch, said third switch moveable between at least one of an accessory and off position and a run position.

26. The method of claim 25 further comprising maintaining said third switch in said one of the accessory and off positions while applying said control voltage to said relay with said capacitor and charging said capacitor with said battery.

27. The method of claim 25 further comprising placing said third switch in the run position and thereby cranking said engine while said relay is positioned in said closed-circuit condition.

* * * * *